US008437659B2

(12) United States Patent
Fukunaga

(10) Patent No.: US 8,437,659 B2
(45) Date of Patent: May 7, 2013

(54) IMAGE FORMING APPARATUS INCLUDING TRANSFER AND FEEDING UNIT

(75) Inventor: Yasuyuki Fukunaga, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 288 days.

(21) Appl. No.: 13/014,825

(22) Filed: Jan. 27, 2011

(65) Prior Publication Data

US 2011/0188885 A1 Aug. 4, 2011

(30) Foreign Application Priority Data

Jan. 29, 2010 (JP) ..... 2010-018961

(51) Int. Cl.
*G03G 15/00* (2006.01)
*G03G 15/16* (2006.01)

(52) U.S. Cl.
USPC ..... 399/110; 399/121; 399/124

(58) Field of Classification Search ..... 399/110, 399/121, 124
See application file for complete search history.

(56) References Cited

U.S. PATENT DOCUMENTS

| | | | | |
|---|---|---|---|---|
| 7,917,062 | B2 * | 3/2011 | Shin et al. | 399/124 |
| 2010/0003051 | A1 | 1/2010 | Sekina et al. | |

FOREIGN PATENT DOCUMENTS

| | | |
|---|---|---|
| JP | 04-066963 | 3/1992 |
| JP | 2001-134164 | 5/2001 |
| JP | 2005-055862 | 3/2005 |
| JP | 2006-017771 | 1/2006 |
| JP | 2010-15060 | 1/2010 |

OTHER PUBLICATIONS

Notice of Reasons for Rejection issued to JP Application No. 2010-018961, mailed May 8, 2012.

* cited by examiner

*Primary Examiner* — William J Royer
(74) *Attorney, Agent, or Firm* — Dilworth & Barrese, LLP.

(57) ABSTRACT

An image forming apparatus includes a housing, a transfer roller configured to be opposite to an image carrier when the housing is rotated around a rotation fulcrum, a transfer roller pressing member configured to urge the transfer roller toward the image carrier, a guide configured to feed transfer paper, a fixing hook configured to be urged in a direction to lock the housing about a main body, a transfer roller releasing lever configured to separate the transfer roller from the image carrier against urging performed by the transfer roller pressing member, a transfer roller positioning part that is disposed in the main body and configured to position the transfer roller, and an operation part configured to cause the fixing hook to rotate in a direction to unlock the housing such that the transfer roller releasing lever rotates in a direction to release the transfer roller from the image carrier.

3 Claims, 18 Drawing Sheets

IMAGE FORMING APPARATUS INCLUDING TRANSFER AND FEEDING UNIT

This application is based on and claims the benefit of priority from Japanese Patent Application No. 2010-018961, filed on 29 Jan. 2010, the content of which is incorporated herein by reference.

BACKGROUND OF THE INVENTION

1. Field of the Invention

The present invention relates to an image forming apparatus provided with a transfer roller arranged opposite to a photosensitive drum (image carrier) carrying a toner image. The image forming apparatus forms the transfer roller and a conveying part in the vicinity of this transfer roller into a unit as a transfer and feeding unit.

2. Related Art

Hitherto, an image forming apparatus has been known which is provided with a transfer roller disposed opposite to a photosensitive drum carrying a toner image and in which the transfer roller and a conveying part in the vicinity of this transfer roller are made into a unit as a transfer and feeding unit.

If the transfer roller can be selectively disposed between a position opposite to the photosensitive drum and another position away therefrom to perform jam troubleshooting in this type of image forming apparatus, positioning of the transfer roller with respect to the photosensitive drum is important. For example, an image forming apparatus is known, in which a portion for positioning a transfer and feeding unit is disposed in a drum housing disposed close to the photosensitive drum or in a main body frame constituting a main body rather than positioning of a transfer roller is performed in the transfer and feeding unit that tends to accumulate larger tolerances.

Also, if the transfer roller is brought close to or away from the photosensitive drum, the transfer roller needs to be continuously pressed by a spring urging a force thereto with respect to the center of the photosensitive drum. Accordingly, it is necessary to employ a guide groove or the like for positioning the transfer roller such that the spring is allowed to press the transfer roller after the transfer and feeding unit is attached. Moreover, it is preferable that a fulcrum of rotation of the transfer and feeding unit is disposed on a lower side of the transfer and feeding unit and an upper side of the transfer and feeding unit is open so that a user can perform jam troubleshooting and the like easily.

SUMMARY OF THE INVENTION

However, if the fulcrum of rotation of the transfer and feeding unit is positioned on the lower side, a distance from the transfer roller to the fulcrum of rotation will increase. Accordingly, it is likely that displacement occurs between a direction of pressing the transfer roller towards the center of the photosensitive drum and a rotational direction of the transfer and feeding unit. Moreover, since it is necessary to form the guide groove for positioning the transfer roller in a direction from the transfer roller toward the photosensitive drum, it is likely that a large angle is formed between a trajectory of rotation of the transfer roller and a movement direction along the guide groove for positioning the transfer roller. Accordingly, a load acts on the transfer roller. As a result, an excessive force required for manipulation (opening/closing) of rotation of the transfer and feeding unit causes it to be less user-friendly.

As a method of easily performing the manipulation of rotation of the transfer unit (opening/closing), it may be possible that pressing of the transfer roller onto the photosensitive drum is adapted to be switchable by a lever operation, for example. However, since a spring pressure to cancel the pressing and a spring pressure of a fixed hook of the transfer and feeding unit occur simultaneously, it may be necessary to exert a large manipulation force. Moreover, since the spring pressure rapidly acts on the transfer roller, it may be that a resulting shock adversely affects a manipulation feeling or noise occurs.

The present invention provides an image forming apparatus that not only increases positioning accuracy of a transfer roller but also renders a transfer and feeding unit to be more user-friendly with a simple configuration.

An image forming apparatus, according to the present invention includes a main body, an image carrier, a housing provided with a rotation fulcrum in a lower part thereof, a transfer roller that is disposed in the housing and configured to be opposite to the image carrier when the housing is rotated around the rotation fulcrum, a transfer roller pressing member that is disposed in the housing and configured to urge the transfer roller toward the image carrier, a guide that is disposed in the housing and configured to feed transfer paper, a fixing hook that is disposed in the housing and configured to be urged in a direction to lock the housing about the main body, a transfer roller releasing lever that is disposed in the housing and configured to separate the transfer roller from the image carrier against urging performed by the transfer roller pressing member, a transfer roller positioning part that is disposed in the main body and configured to position the transfer roller, and an operation part configured to cause the fixing hook to rotate in a direction to unlock the housing such that the transfer roller releasing lever rotates in a direction to release the transfer roller from the image carrier.

It may be preferable but not necessary that the transfer roller releasing lever is urged onto the transfer roller pressing member such that the fixing hook is restricted from moving to a position to unlock the transfer roller, when the transfer roller is positioned with respect to the image carrier.

In addition, it may be preferable but not necessary that the operation part is a handle to open and close a panel that constitutes a part of an outer wall of the main body.

An image forming apparatus of the present invention not only improves positioning accuracy of the transfer roller but also implements more user-friendly operation of the transfer and feeding unit, while a simple configuration is preserved.

DETAILED DESCRIPTION OF THE INVENTION

An image forming apparatus according to an embodiment of the present invention will be described referring to the attached drawings. The embodiment shown below is a preferable example of the image forming apparatus of the present invention. Though various technically preferable limitations are given, the technical scope of the present invention is not limited by these modes unless otherwise specifically limited in description.

Entire Configuration of Multipurpose Machine 11

Figure 1:
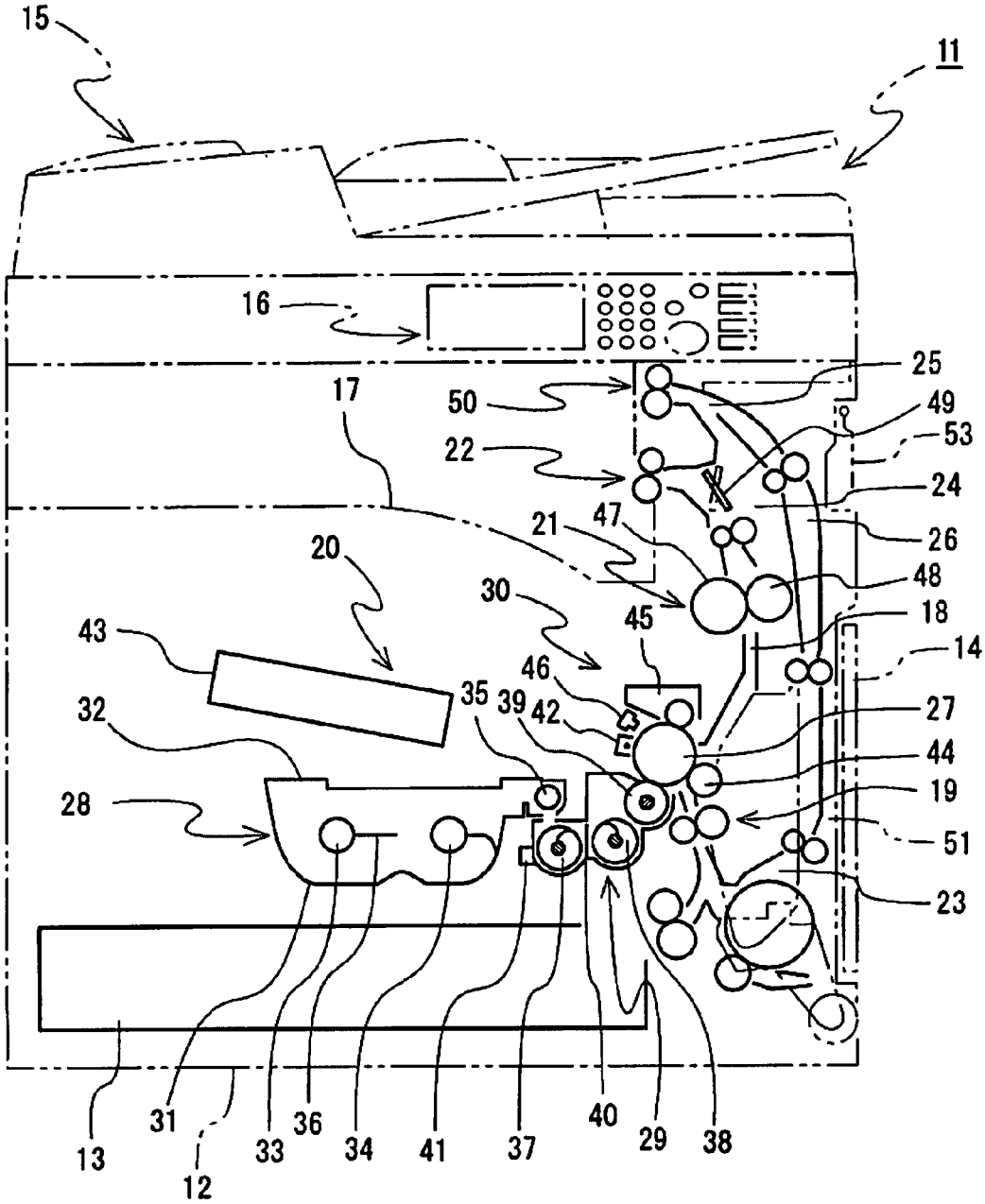
FIG. 1 is a diagram illustrating a multifunction machine as an image forming apparatus according to an embodiment of the present invention.

In FIG. 1, a multipurpose machine 11 as an image forming apparatus includes functions of a copier, a printer, a facsimile machine, and a scanner.

The multipurpose machine 11 as an image forming apparatus according to an embodiment of the present invention includes a main body 12, a paper feed cassette 13, a manual feed tray 14, an automatic document feeder (ADF) 15, and an operation part 16.

The paper feed cassette 13 can be withdrawn from a front face of the main body 12. The manual feed tray 14 is openably and closably disposed on one of side faces of the main body 12, so that one type of transfer paper (not shown) different from another type of transfer paper (not shown) contained in the paper feed cassette 13 can be used. The automatic document feeder (ADF) 15, which is used for reading a document, has various functions of a copier, a facsimile machine, and a scanner. The operation part 16 performs an operation of setting or selection of the various functions. The shape, configuration, function and the like of the multipurpose machine 11 are not limited to those shown in the figure.

Internal Setup of Main Body 12

Inside the main body 12, a paper feeding path 18, a pair of resist rollers 19, an image forming part 20, a fixation part 21, and a discharge part 22 are disposed.

The paper feeding path 18 feeds the transfer paper contained in the paper feed cassette 13 toward a paper discharge tray 17. The pair of resist rollers 19 are disposed upstream in a direction of transfer paper fed by the paper feeding path 18. The image forming part 20 is disposed more downstream in the direction of the transfer paper fed by the paper feeding path 18 than the pair of resist rollers 19. The fixation part 21 fixes a toner image that has been transferred onto the surface of transfer paper by the image forming part 20. The discharge part 22 is disposed most downstream with respect to the paper feeding path 18 within the main body 12.

Moreover, the paper feeding path 18 has a plurality of paths branched or merged. In this embodiment, the paper feeding path 18 includes a tray paper-feed path 23, a branch path 24, a switch-back path 25, and a reversing path 26.

The tray paper-feed path 23 is disposed most upstream in the direction of transfer paper fed by the paper feeding path 18, and the transfer paper supplied from the manual feed tray 14 merges thereto. The branch path 24 is disposed more downstream in the direction of transfer paper fed by the paper feeding path 18 than the fixation part 21. The switch-back path 25 reverses a sheet of transfer paper fed by the branch path 24 in the case of double-sided printing. The reversing path 26 returns the sheet of transfer paper that has been reversed by the switch-back path 25 to the paper feeding path 18 on a more upstream side with respect to the direction of feeding transfer paper than the pair of resist rollers 19.

Configuration of Pair of Resist Rollers 19

At the pair of resist rollers 19, a resist sensor (not shown) detects a leading end in a direction of feeding a sheet of transfer paper taken out of the paper feed cassette 13 or the manual feed tray 14. In this manner, the pair of resist rollers 19 synchronizes the leading end position of the sheet of transfer paper with the position of a toner image formed on the surface of a photosensitive drum (image carrier) 27 constituting the image forming part 20.

Specifically, after a predetermined time has elapsed subsequent to detection of the leading end of the sheet of transfer paper by the resist sensor, rotational driving of the pair of resist rollers 19 is started. Then, after a predetermined time has elapsed subsequent to detection of a rear end of the sheet of transfer paper by the resist sensor, the rotational driving of the pair of resist rollers 19 is stopped. Also, the resist sensor detects a sheet length along the feeding direction of the sheet of transfer paper fed to the paper feeding path 18 out of the paper feed cassette 13. The resist sensor detects the length of the sheet of transfer paper (in the direction along feeding of the sheet of transfer paper) by an amount of time elapsed between the detection of the leading end of the sheet of transfer paper and the detection of the rear end thereof.

The pair of resist rollers 19 is interlocked with a driving source (not shown) such as a motor. And the pair of resist rollers 19 corrects skewing of a sheet of transfer paper by stopping feeding thereof instantaneously when the leading end of the sheet of transfer paper is introduced into a nip.

Configuration of Image Forming Part 20

In this embodiment, the image forming part 20 includes a replenishment toner container 28, a development unit 29, and a transfer part 30.

Configuration of Replenishment Toner Container 28

The replenishment toner container 28 includes a container main body 31 in which replenishment toner is contained and a container cover 32 that closes an upper aperture of the container main body 31. Also, the replenishment toner container 28 includes a pair of toner agitating members 33 and 34 and a spiral rod 35.

The toner agitating members 33 and 34 are disposed across from one side (driving part side) of the container main body 31 to the other side thereof. Also, the toner agitating members 33 and 34 are each provided with an agitating blade 36 and agitate the toner contained in the container main body 31 while feeding the toner to the spiral rod 35.

The spiral rod 35 feeds the toner for replenishment having been agitated and fed by the toner agitating members 33 and 34 toward one side in a transfer paper width direction. Then, the spiral rod 35 supplies the toner for replenishment to the development unit 29 from the one side.

The replenishment toner container 28 can be detachably attached (replaceable) to the main body 12. That is, by opening a front cover (not shown) of the main body 12, the replenishment toner container 28 can be detachably attached (replaced).

Configuration of Development Unit 29

The development unit 29 supplies toner to the photosensitive drum 27 as an image carrier while circulating and moving the toner inside a housing. The development unit 29 rotatably provides a pair of spiral feeders (agitating mixers) 37 and 38 and a development roller 39 opposite to the photosensitive drum 27 in such order from upstream with respect to a toner supplying direction.

Also, a bulkhead 40 that divides the spiral feeder 37 from the spiral feeder 38 is formed inside the development unit 29. At both ends of the bulkhead 40, a gap is formed between each end and a vertical wall of the development unit 29 (a wall facing each end in a transfer paper width direction, which is orthogonal to the sheet in FIG. 1). The toner is replenished from the replenishment toner container 28 on one side in the transfer paper width direction. The toner including the replenished toner is agitated and fed (outbound path) toward one side of the development unit 29 (a depth direction with respect to the sheet of FIG. 1) by the spiral feeder 37 disposed below the spiral rod 35. Subsequently, the movement direction of the toner is switched by the gap on the one side, so that the toner is agitated and fed (inbound path) by the spiral feeder 38 to the other side of the development unit 29 (a front direction with respect to the sheet of FIG. 1). After that, the movement direction of the toner is switched again in the gap on the other side.

Moreover, a toner sensor 41 that detects an amount of toner of the development unit 29 is disposed on an outer wall surface of the development unit 29.

The development roller 39 is arranged such that its peripheral face is configured to be opposite to a peripheral face of the photosensitive drum 27. In this manner, the toner fed by the development roller 39 is supplied to the peripheral face of the photosensitive drum 27 through the development roller 39. As a result, a toner image according to an electrostatic latent image is formed on the peripheral face of the photosensitive drum 27.

The toner sensor 41 detects the toner amount in the vicinity of a spot of the installed toner sensor 41 (in the vicinity of the toner replenishment part) based on an output signal thereof. A control circuit (not shown) causes the replenishment toner container 28 to control an amount of replenished toner, replenishment timing and the like based on the amount of the toner detected by the toner sensor 41.

Configuration of Transfer Part 30

The transfer part 30 includes a charging device 42, an exposure device 43, the development roller 39, a transfer roller 44, a cleaning device 45, and a static charge eliminating device 46. These components are disposed around the photosensitive drum 27 (made of amorphous silicon, for example), according to the order of an image forming process along a rotational direction (counter clockwise direction in FIG. 1) of the photosensitive drum 27.

A charging bias in which an AC voltage (Vac) is superimposed on a DC voltage (Vdc) is applied to the charging device 42.

The exposure device 43 processes image data included in printing data transmitted from a personal computer, not shown, for example, and irradiates laser beams onto the surface of the photosensitive drum 27. In this connection, the printing data may include data relating to various kinds of setting such as the number of image forming processing parts, an enlargement/reduction rate, image density and the like, for example, in addition to the above-described image data.

A transfer voltage is applied to the transfer roller 44. The transfer roller 44 transfers the toner image formed on the surface of the photosensitive drum 27 by the voltage applied to the transfer roller 44 while feeding a sheet of transfer paper by the nip in collaboration with the photosensitive drum 27.

The cleaning device 45 removes the toner, dust particle of the sheet of transfer paper and the like remaining on the surface of the photosensitive drum 27 after the toner is transferred to the sheet of transfer paper.

An LED light source or the like is used as the static eliminating device 46, for example. The static eliminating device 46 eliminates static electricity of the photosensitive drum 27 charged by the charging device 42.

Configuration of Fixation Part 21

The fixation part 21 fixes an unfixed toner image having been transferred onto the surface of a sheet of transfer paper by the image forming part 20. The fixation part 21 includes a heating roller 47 (or a heating belt) and a pressure roller 48 as a pressure member. The heating roller 47 (or the heating belt) is disposed on a front side (a side provided with an unfixed toner image) of the transfer paper. The pressure roller 48 is configured to be opposite to the heating roller 47 such that they interpose the paper feeding path 18 between them. The fixation part 21, which forms a nip by bringing this pressure roller 48 into pressure contact with the heating roller 47, feeds a sheet of transfer paper.

The unfixed toner image formed on the surface of the sheet of transfer paper comes into direct contact with the heating roller 47 and melts. Then, the sheet of transfer paper to which pressure is applied from its back side by the pressure roller 48, the melted toner is fixed as a fixed image on the front side of the transfer paper.

A treatment of surface coating or the like is applied to the surface of the heating roller 47 so that the melted toner does not adhere thereto. Also, the melted toner or the like adhering to the surface of the heating roller 47 is removed by a cleaning device or the like, not shown.

Configuration of Each Paper Feeding Path

The paper feeding path 18 forms a path that feeds the uppermost sheet of transfer paper, which is taken out of the paper feed cassette 13 by a cassette paper feed part, to the pair of resist rollers 19, the transfer part 30 (the photosensitive drum 27 and the transfer roller 44) and the fixation part 21 in such order. In addition, the paper feeding path 18 forms a path from the discharge part 22 to the paper discharge tray 17.

The tray paper-feed path 23 forms a path that feeds the uppermost sheet of transfer paper taken out of the paper feed tray by a tray paper feed part toward the pair of resist rollers 19.

The branch path 24 includes a switching member 49 that switches a path for feeding a sheet of transfer paper to more downstream in a feeding direction than the fixation part 21 of the paper feeding path 18. The branch path 24 forms a path that feeds the sheet of transfer paper to the switch-back path 25 through switching of paths performed by the switching member 49.

The switch-back path 25 includes a pair of switch-back rollers 50 that are disposed above the discharge part 22 and rotatable clockwise and counterclockwise. The switch-back path 25 forms a path that feeds the switched-back transfer paper toward the reversing path 26.

The reversing path 26 is formed by the main body 12 and a side panel 51. The reversing path 26 forms a path that feeds the sheet of transfer paper having been fed from the switch-back path 25 toward the pair of resist rollers 19.

Configuration of Side Panel 51

Figure 2:
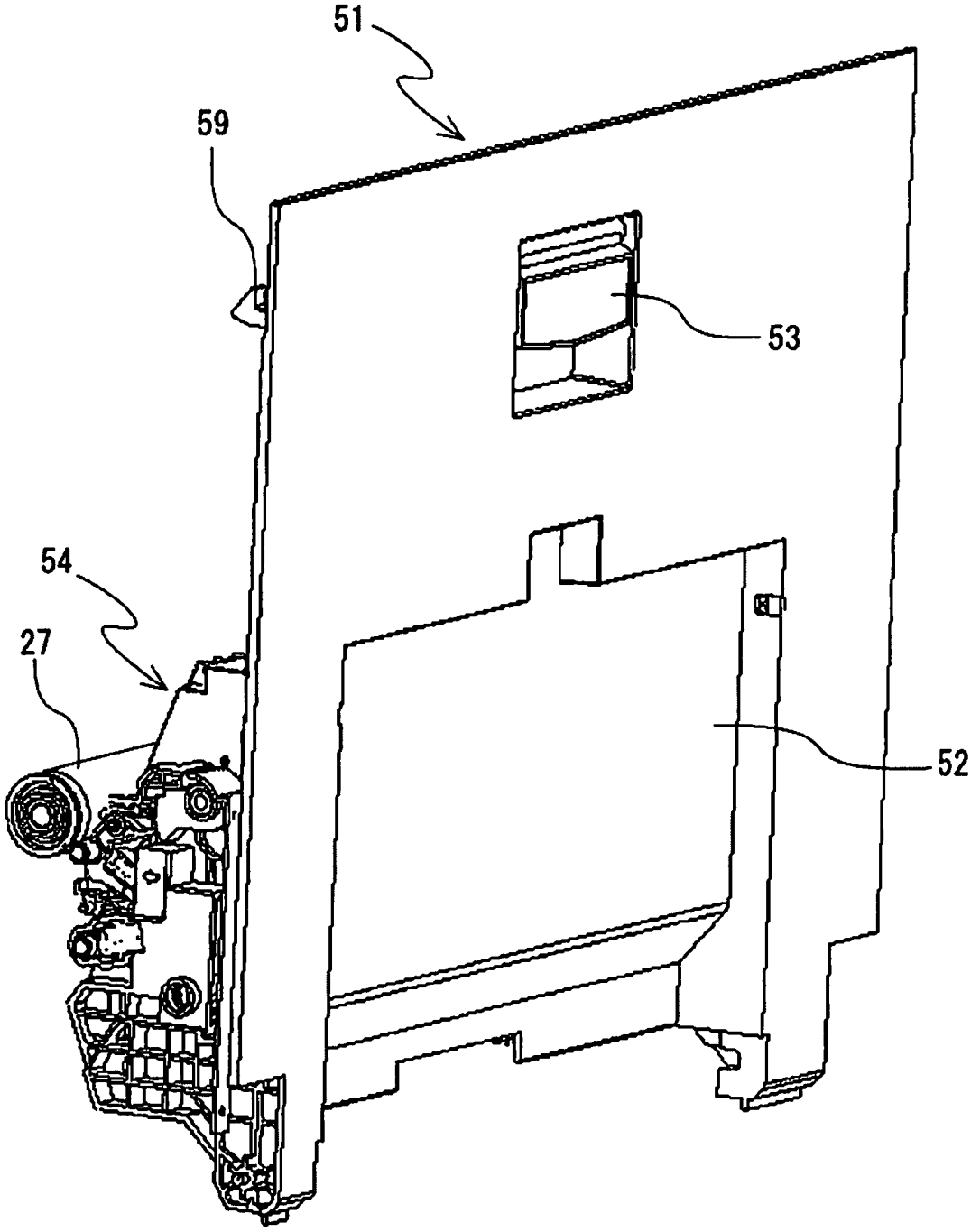
FIG. 2 is a perspective view of a side panel applied to the image forming apparatus according to the embodiment of the present invention.

The side panel 51 forming a part of one of outer wall surfaces of the multipurpose machine 11 includes a recess part 52, an opening and closing handle 53 (operation part, handle), and a transfer and feeding unit 54 as shown in FIG. 2. The recess part 52 is formed in a lower part of the outer wall surface of the side panel 51. The side panel 51 rotatably supports the manual feed tray 14 and accommodates the manual feed tray 14 when it is not in use. The opening and closing handle 53 is pivotably disposed in an upper part of the outer surface of the side panel 51. The transfer and feeding unit 54 is located inside the main body 12 and rotatably supported in a lower part on the back face of the side panel 51.

Figure 3:
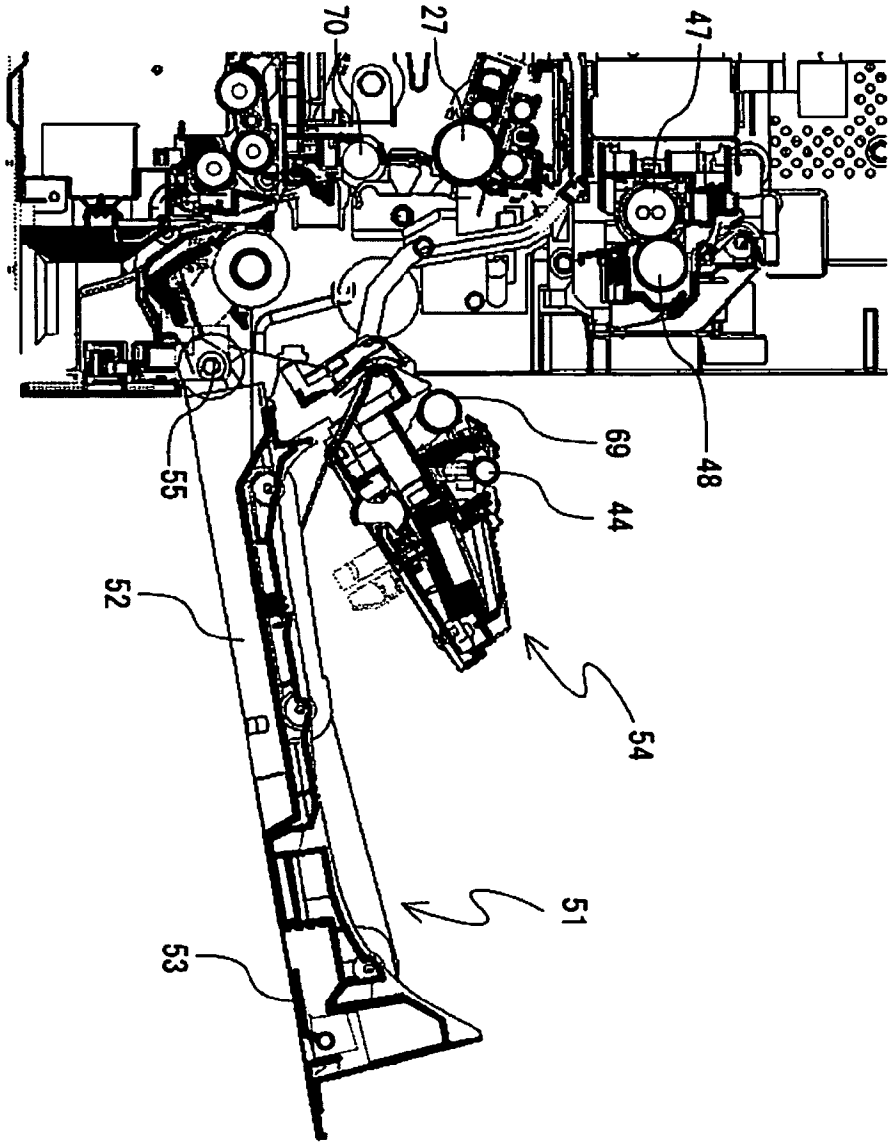
FIG. 3 is a sectional view of an essential part of the image forming apparatus according to the embodiment of the present invention, when a side panel is open.
Figure 4:
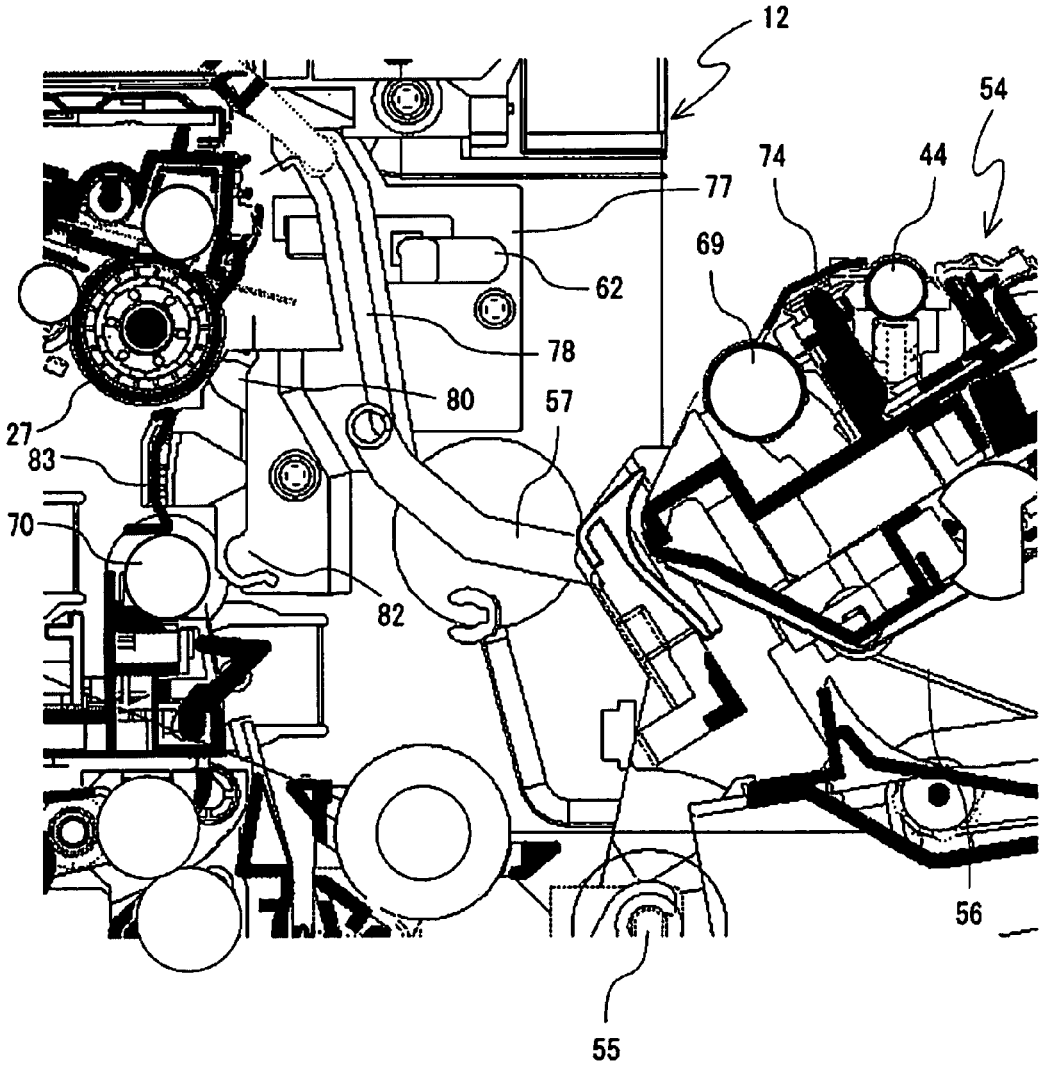
FIG. 4 is an enlarged sectional view of the essential part of the image forming apparatus according to the embodiment of the present invention, when the side panel is open.
Figure 5:
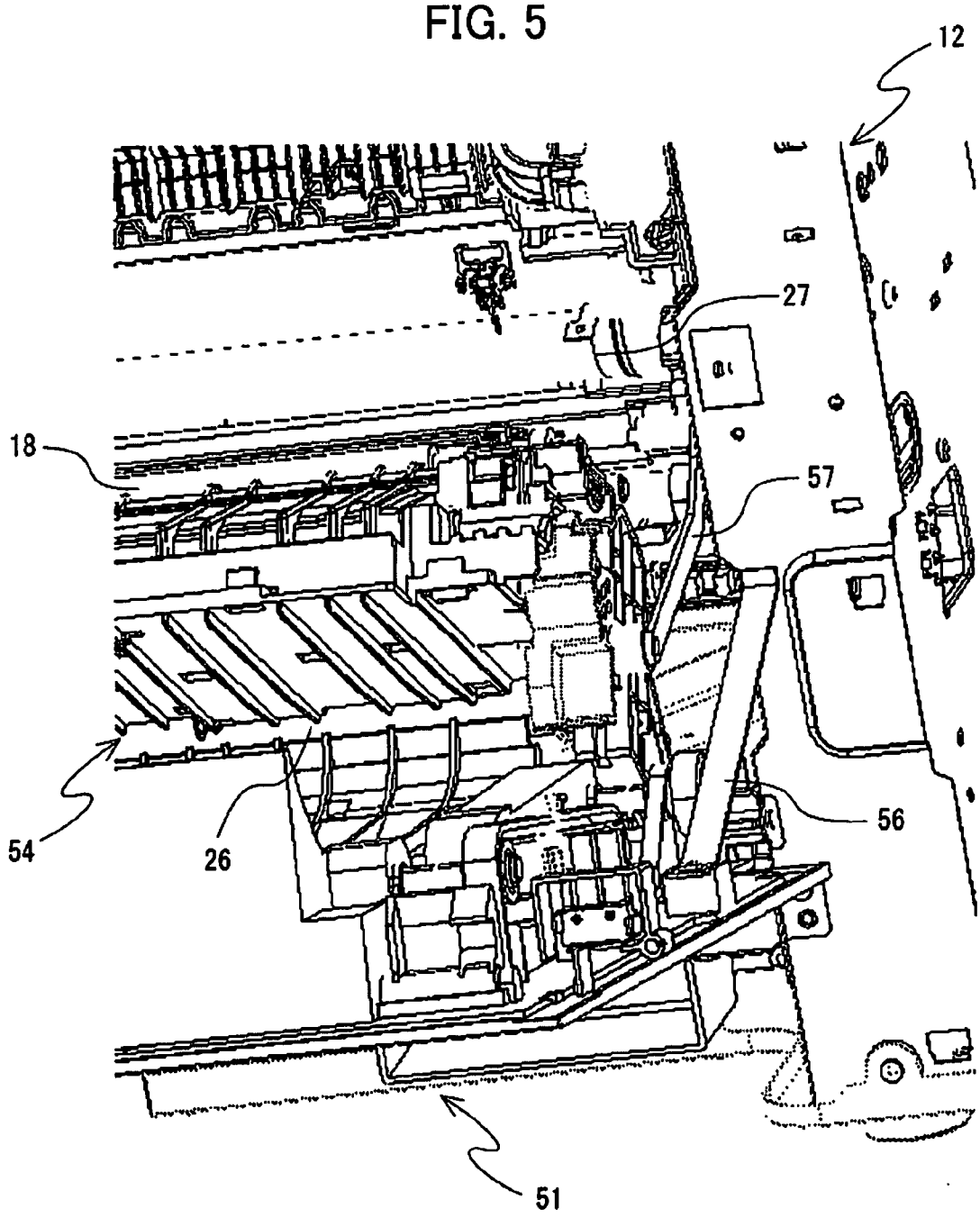
FIG. 5 is a diagram illustrating the essential part of the image forming apparatus according to the embodiment of the present invention.
Figure 6:
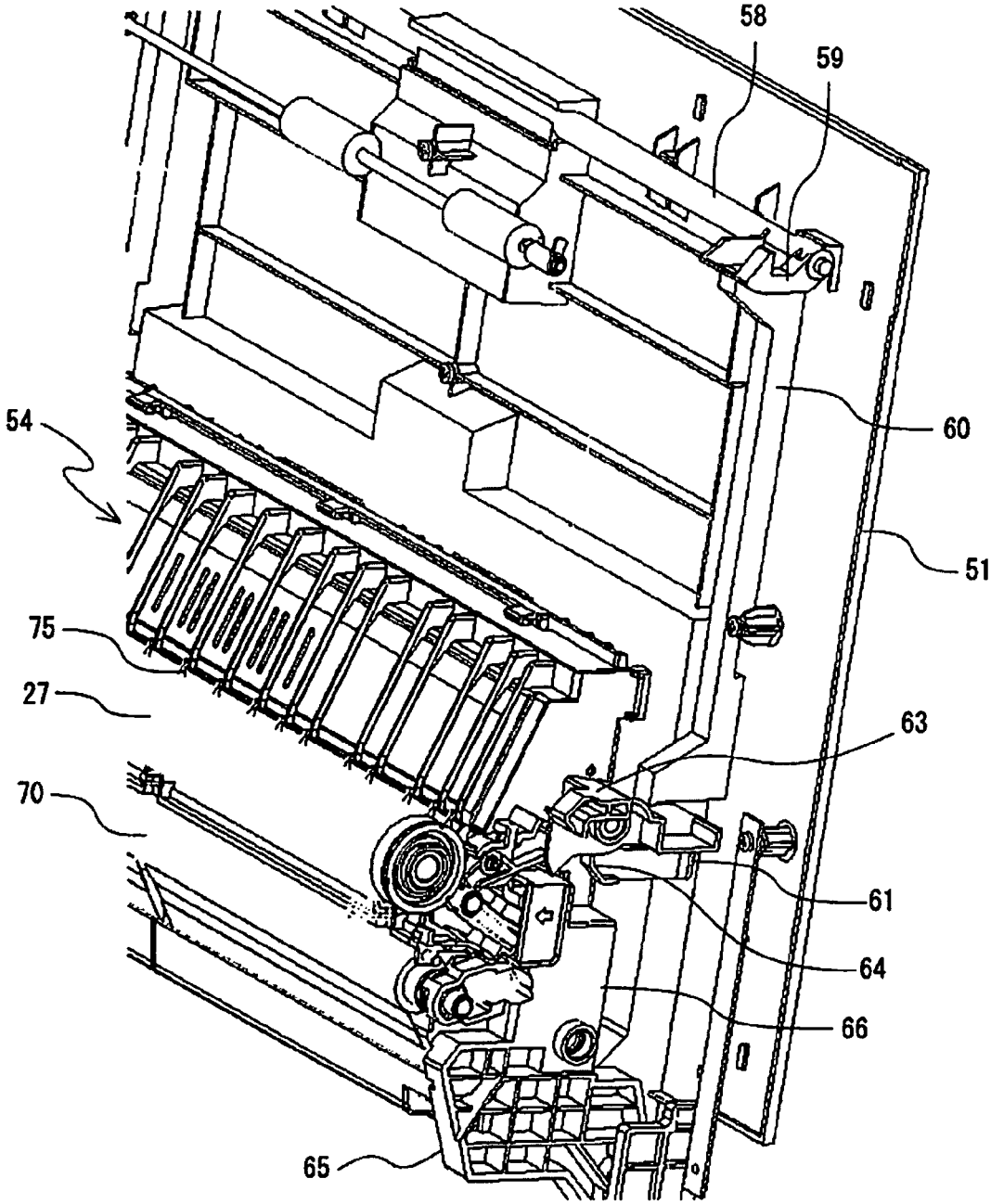
FIG. 6 is a perspective view of the essential part of the side panel in a locked state applied to the image forming apparatus according to the embodiment of the present invention.
Figure 7:
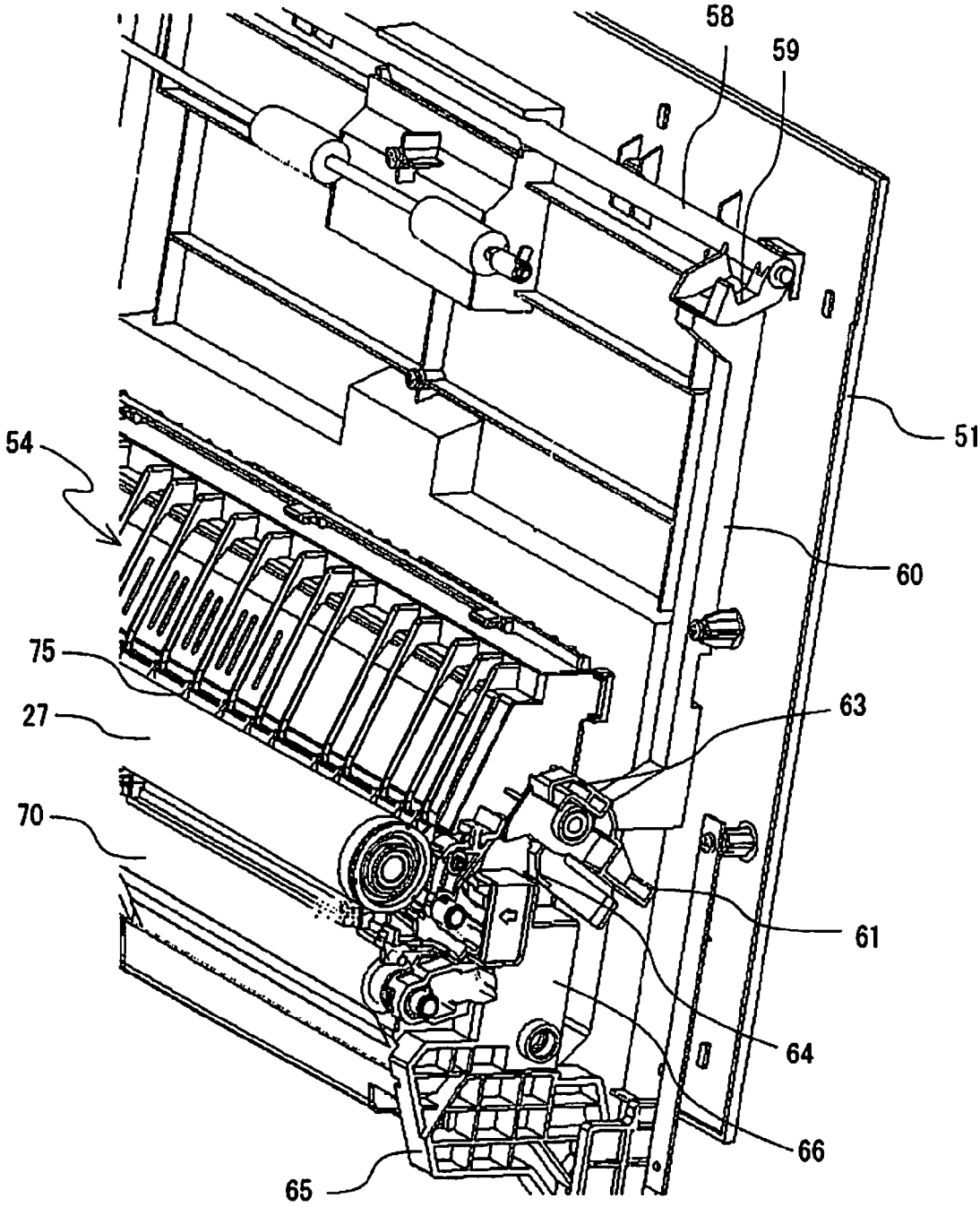
FIG. 7 is a perspective view of the essential part of the side panel in an unlocked state applied to the image forming apparatus according to the embodiment of the present invention.

Also, the side panel 51 and the transfer and feeding unit 54 are rotatable around the same unit supporting shaft 55 disposed in a lower part of the main body 12 as shown in FIG. 3. As shown in FIGS. 4 and 5, the side panel 51 and the transfer and feeding unit 54 open differently from each other due to a difference in the length between a cover strap 56 and a unit strap 57, each end of which is fixed to the main body 12. The side panel 51 and the transfer and feeding unit 54 can be brought into an open state upwardly exposed since each uses the unit supporting shaft 55 as a rotational fulcrum. As a result, it is possible to easily perform a replacement work of the transfer roller 44 and jam troubleshooting.

Moreover, the side panel 51 in a closed position supports the transfer and feeding unit 54 so as to regulate an interval between one back face of the side panel 51 and another back face of the transfer and feeding unit 54 opposite to the one back face (an interval in a thickness direction of the transfer paper in the reversing path 26). And the transfer and feeding unit 54 is released from the support given by the side panel 51, while synchronizing with an opening operation of the side panel 51 by the opening and closing handle 53. In this manner, the transfer roller 44 is configured to lie away from the photosensitive drum 27.

As shown in FIGS. 6 to 8B, the opening and closing handle 53 is rotatably supported by a panel supporting shaft 58 disposed in an upper part of the back face of the side panel 51. The opening and closing handle 53 rotates cover fixing hooks 59 that are disposed at both ends of the panel supporting shaft 58 and engaged with a cover fixing part (not shown) of the main body 12 while interlocking with a rotational operation through the opening and closing handle 53. Also, on the back face of the side panel 51, a connecting slider 60 and a unit fixing hook (fixing hook) 61 are disposed. The connecting slider 60 slides and shifts in a vertical direction while interlocking with the rotation of a cover fixing hook 59. The unit fixing hook 61 is rotatable so as to be brought into contact with a lower end of the connecting slider 60. The unit fixing hook 61 rotates as the connecting slider 60 moves downward. As a result, the transfer and feeding unit 54 in a supported state provided by the side panel 51 is released.

The unit fixing hook 61 includes a hook part 63 and a separation part 64. The hook part 63 engages with a unit fixing hook engagement part 62 disposed on the main body 12 so as to position an entirety of the transfer and feeding unit 54. While interlocking with the opening operation through the opening and closing handle 53, the separation part 64 separates the transfer roller 44 from the photosensitive drum 27. The hook part 63 is urged (by a torsion spring e.g.) to the unit fixing hook 61 in a direction in which the hook part 63 engages with the unit fixing hook engagement part 62.

Also, the unit fixing hook 61 and the connecting slider 60 each have a projection (not shown) so as to connect each other in the direction of rotating of the transfer and feeding unit 54. When the opening and closing handle 53 is in a state of rotational operation, the connection of the unit fixing hook 61 and the connecting slider 60 is strong by the strong contact of the unit fixing hook 61 and the connecting slider 60. As a result, the transfer and feeding unit 54 rotates by integrating with the side panel 51.

Configuration of Transfer and Feeding Unit 54

As shown in FIGS. 9A to 12, the transfer and feeding unit 54 includes a unit base housing 66 and a transfer roller unit 68. The unit base housing 66 is fixed at both ends thereof to a lower part of the main body 12 by a unit base bracket 65 through which a unit supporting shaft 55 passes. The transfer roller unit 68 is held by a transfer roller unit holding part 67 disposed in the unit base housing 66.

The unit base housing 66 directly and rotatably holds one of the pair of resist rollers 19, namely one resist roller 69, which is located on a closer side of the side panel 51. Also, the unit base housing 66 includes a resist roller pressing spring 71 that urges the one resist roller 69 toward the other resist roller 70 inside the main body 12. A front surface, back surface and bottom surface of the unit base housing 66 form a part of each of the conveying path 18 and the reversing path 26 described above.

Figure 8A:
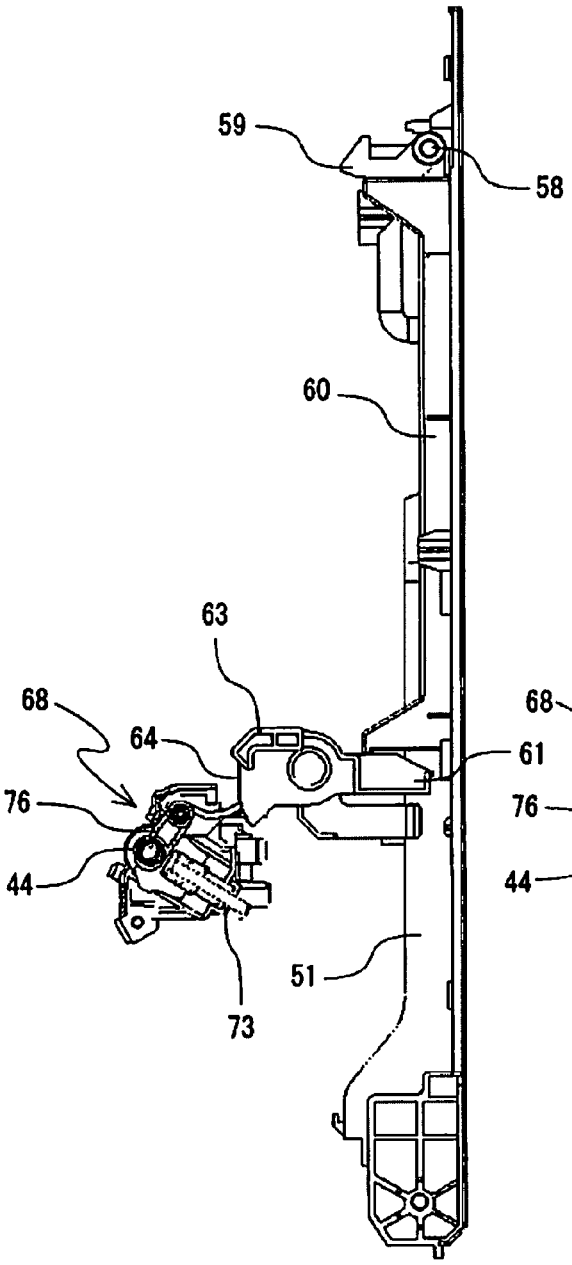
FIG. 8A is a side view of the side panel in the locked state applied to the image forming apparatus according to the embodiment of the present invention.
Figure 8B:
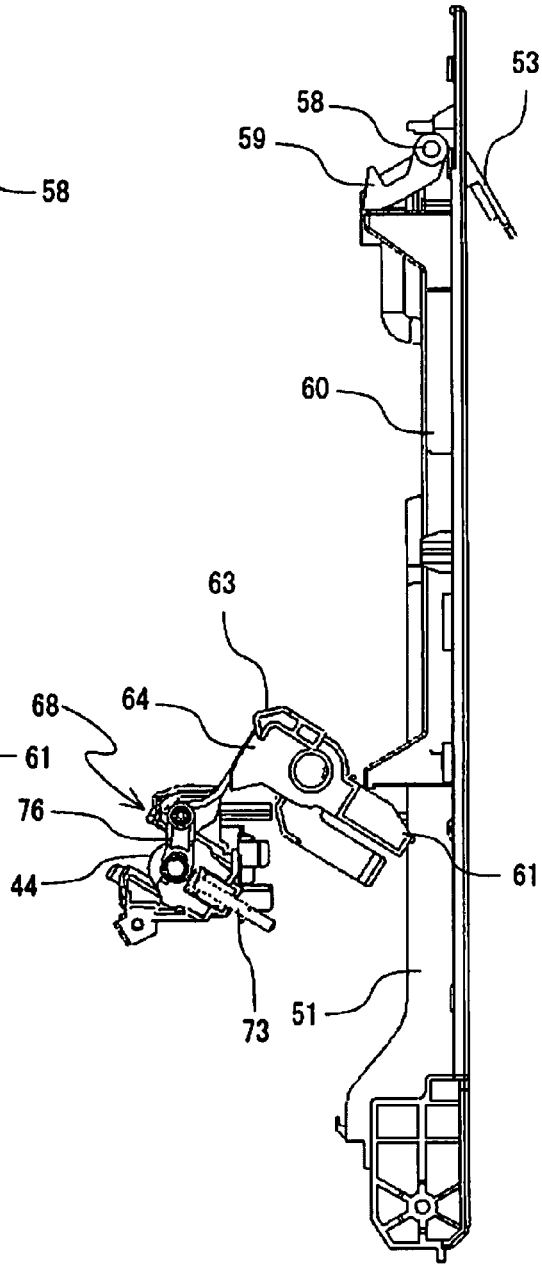
FIG. 8B is a side view of the side panel in the unlocked state applied to the image forming apparatus according to the embodiment of the present invention.
Figure 9A:
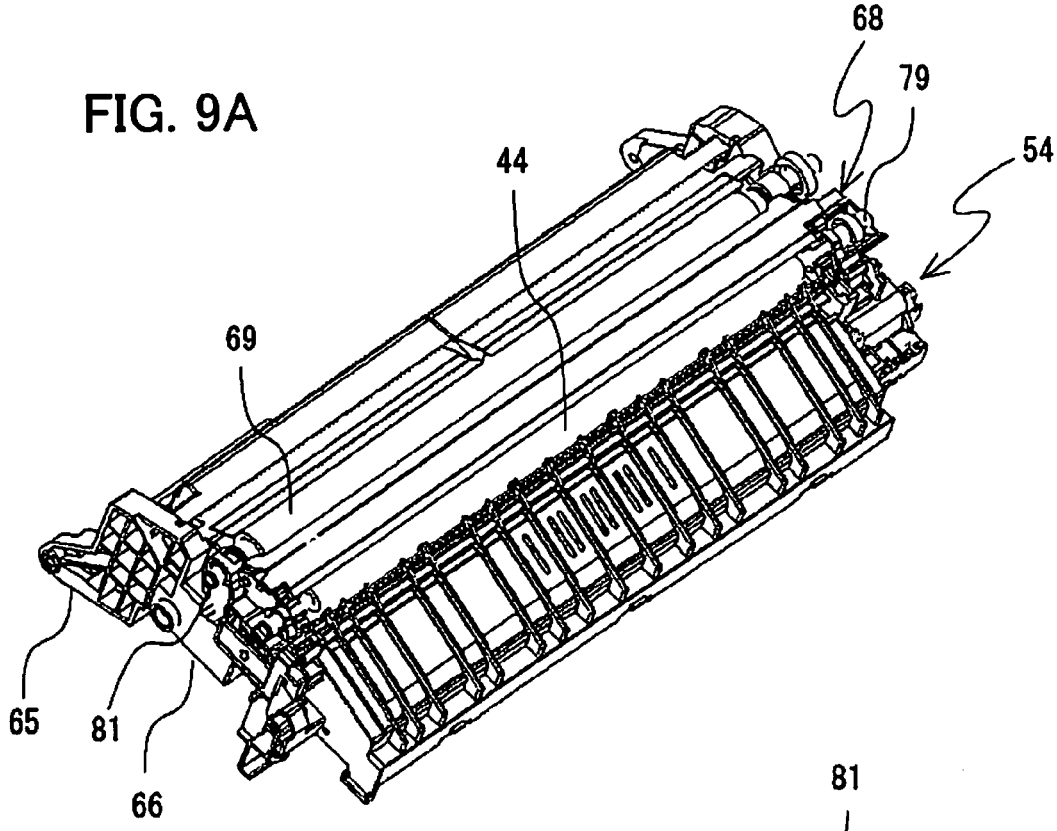
FIG. 9A is a perspective view of a transfer and feeding unit applied to the image forming apparatus according to the embodiment of the present invention.
Figure 9B:
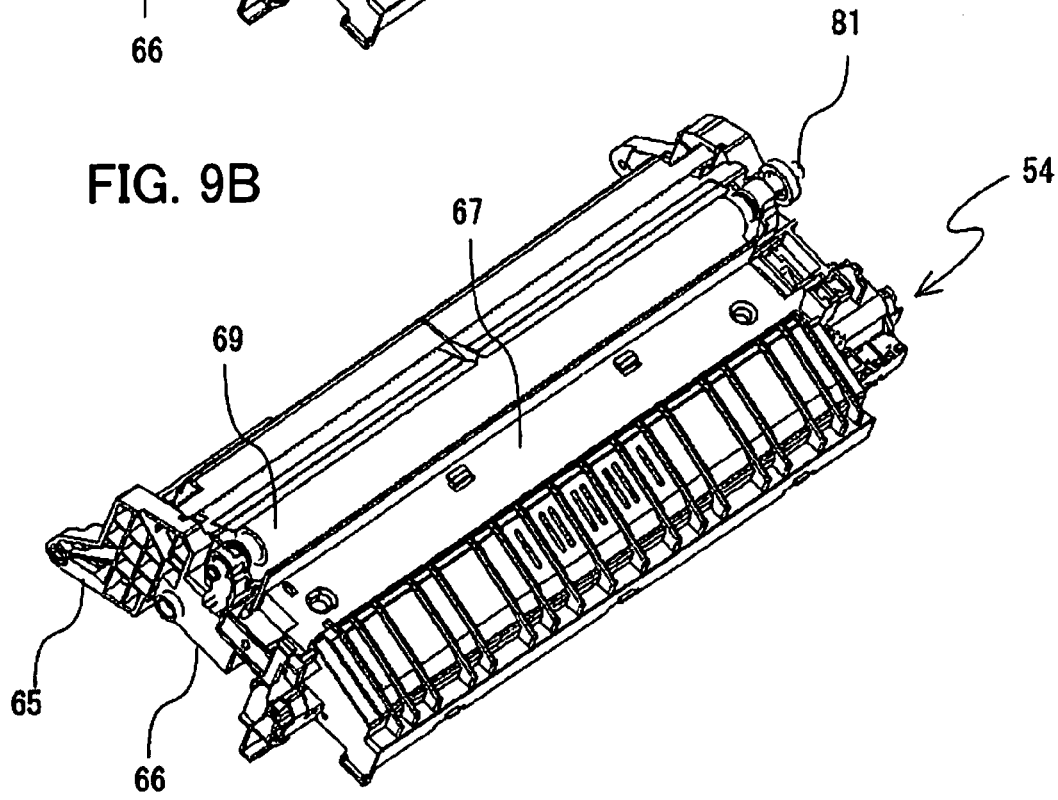
FIG. 9B is a perspective view of the transfer and feeding unit applied to the image forming apparatus according to the embodiment of the present invention, when a transfer roller unit is removed.
Figure 10:
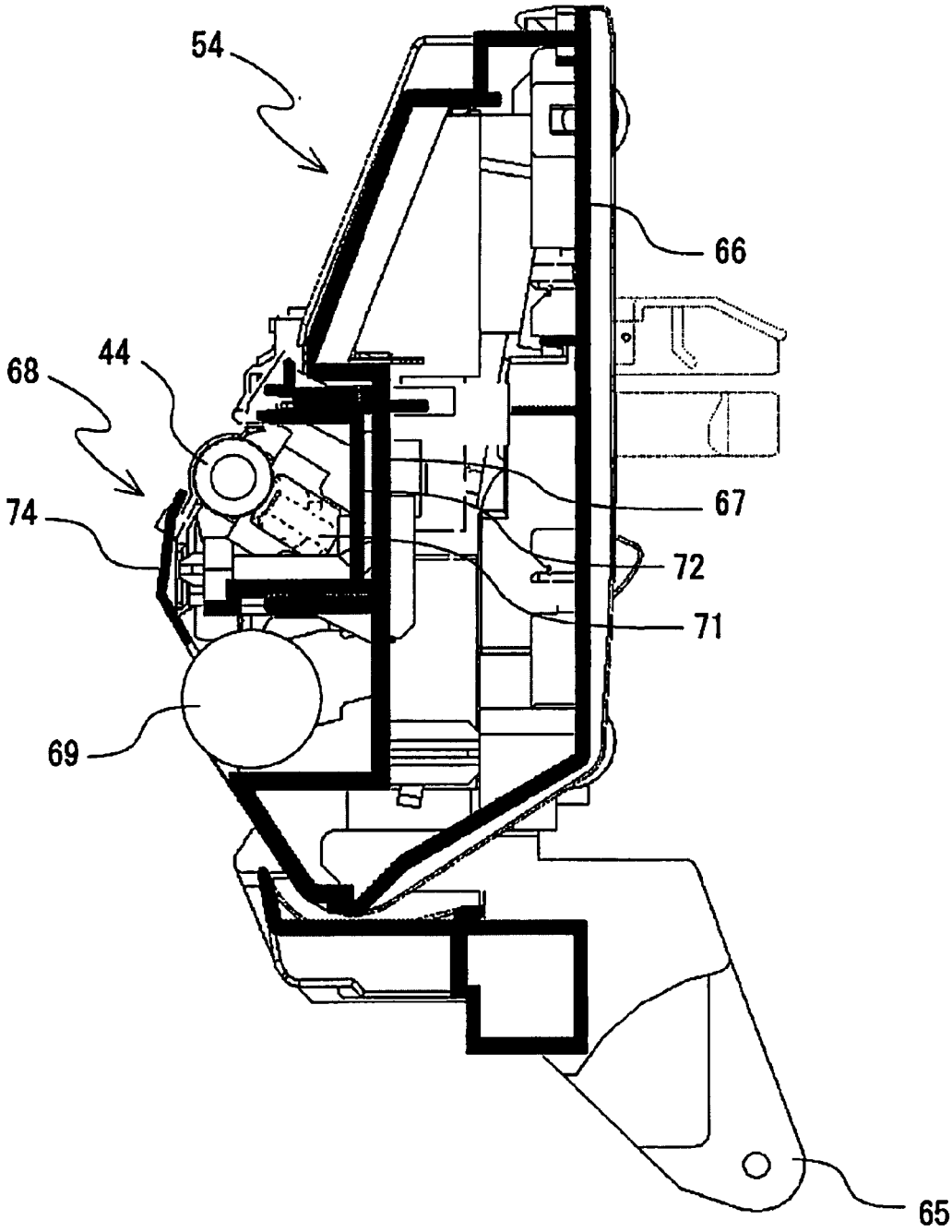
FIG. 10 is a sectional view of the transfer and feeding unit in the image forming apparatus according to the embodiment of the present invention.
Figure 11:
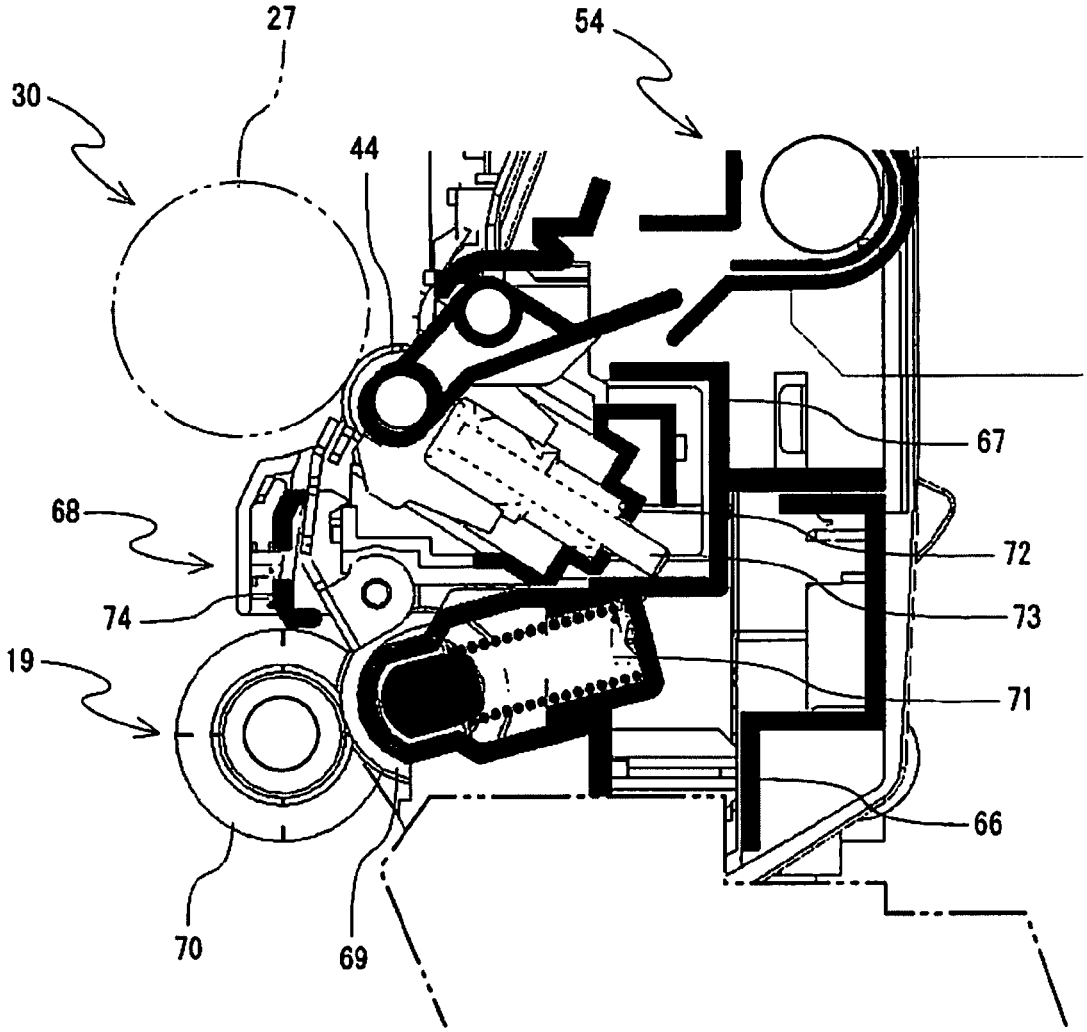
FIG. 11 is a sectional view of the essential part of the transfer and feeding unit in the image forming apparatus according to the embodiment of the present invention.
Figure 12:
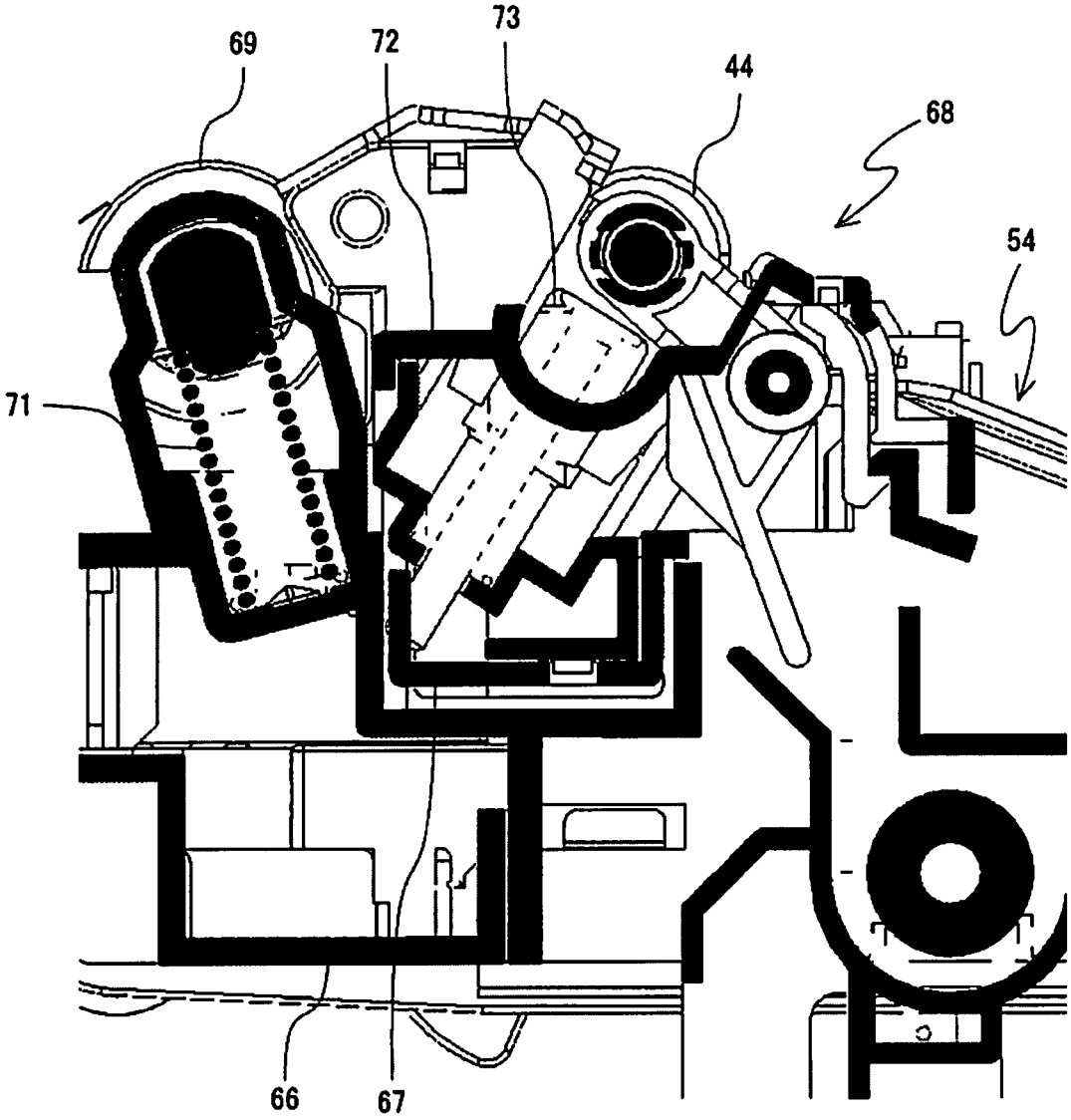
FIG. 12 is an enlarged sectional view of the essential part of the transfer and feeding unit in the image forming apparatus according to the embodiment of the present invention.
Figure 13:
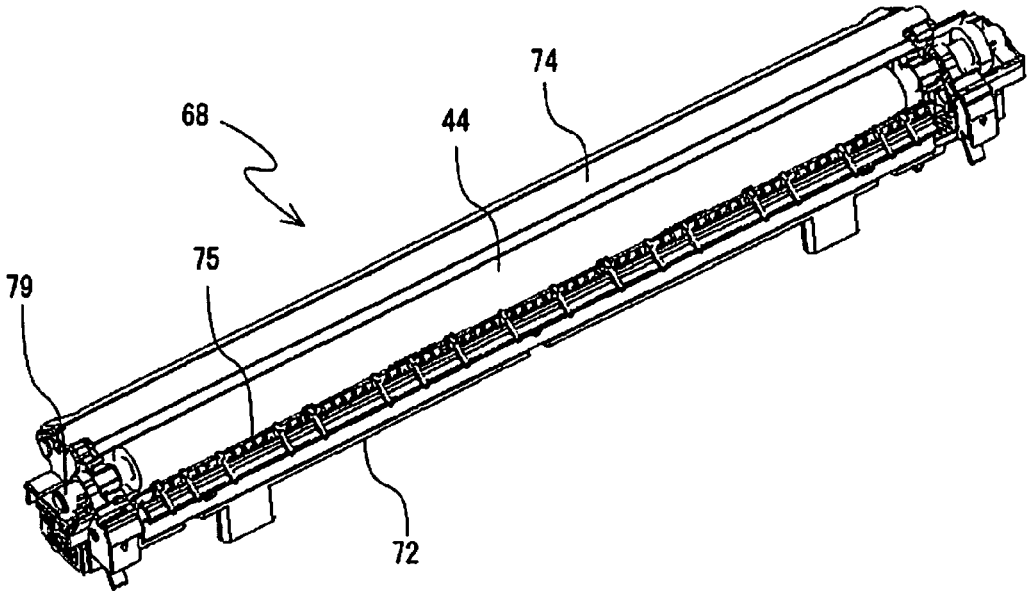
FIG. 13 is a perspective view of the transfer roller unit in the image forming apparatus according to the embodiment of the present invention.

The transfer roller unit 68 includes, as shown in FIG. 13, a transfer roller housing (housing) 72, the transfer roller 44, the transfer roller pressing spring (transfer roller pressing member) 73 (see FIGS. 8A and 8B), a pre-transfer back face guide (guide) 74, a separation needle 75, and a transfer roller releasing lever 76 (see FIGS. 8A and 8B).

The transfer roller housing 72 is contained in the transfer roller unit holding part 67. The transfer roller pressing spring 73 urges the transfer roller 44 toward the photosensitive drum 27. The pre-transfer back-face guide 74 is one (on a side of the side panel 51) of a pair of pre-transfer guides that forms the feeding path 18 between the pair of resist rollers 19 and the transfer part 30. The separation needle 75 separates a sheet of transfer paper from the photosensitive drum 27. The transfer roller releasing lever 76 abuts with a separation part 64 of the unit fixing hook 61 so as to contract the transfer roller pressing spring 73 against urging force, such that the transfer roller 44 is separated from the photosensitive drum 27.

When the side panel 51 is opened, the transfer roller 44 is not brought into contact with the photosensitive drum 27 more than necessary. Accordingly, the photosensitive drum 27 is prevented from suffering from damage at a time of starting to open the side panel 51.

A plurality of separation needles 75 are arranged along the transfer paper width direction so that their distal ends are exposed to the paper feeding path 18 more downstream than the transfer roller 44 in a direction of feeding the transfer paper. Each separation needle 75, to which a separation voltage is applied, discharges between itself and the photosensitive drum 27. Then, the separation needles 75 eliminate static electricity from a sheet of transfer paper charged by the transfer roller 44 and separate the sheet of transfer paper from the photosensitive drum 27.

Configuration of Main Body 12

Figure 14:
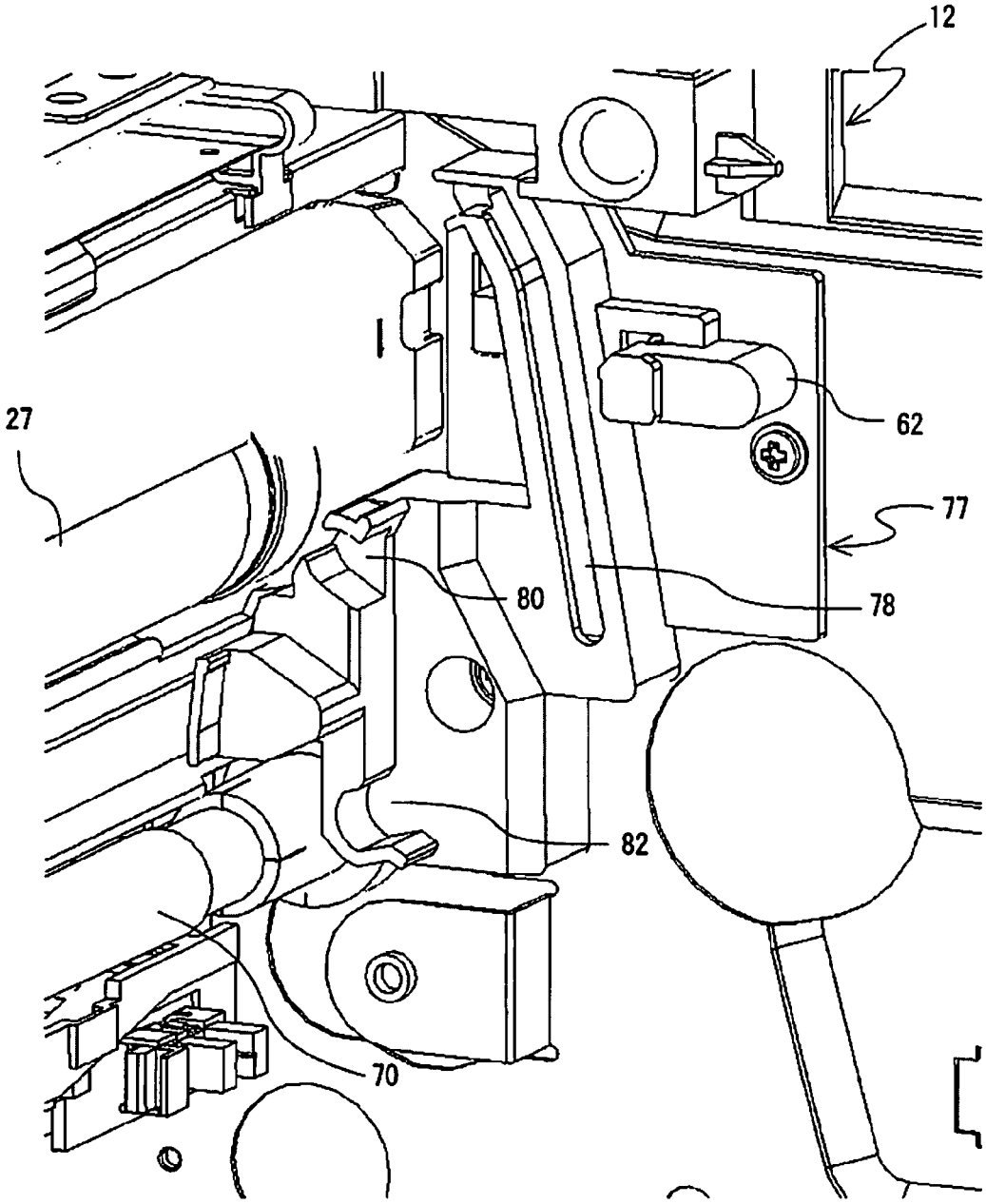
FIG. 14 is a perspective view of an essential part related to a main body in the image forming apparatus according to the embodiment of the present invention.

As shown in FIG. 14, the main body 12 includes the photosensitive drum 27, the other resist roller 70, and a unit fixation resin member 77.

The unit fixation resin member 77 includes a unit strap guide groove 78, a unit fixing hook engagement part 62, a transfer roller positioning part 80, a resist roller positioning part 82, and a pre-transfer front face guide 83 as the other pre-transfer guide (see FIG. 4).

Figure 15:
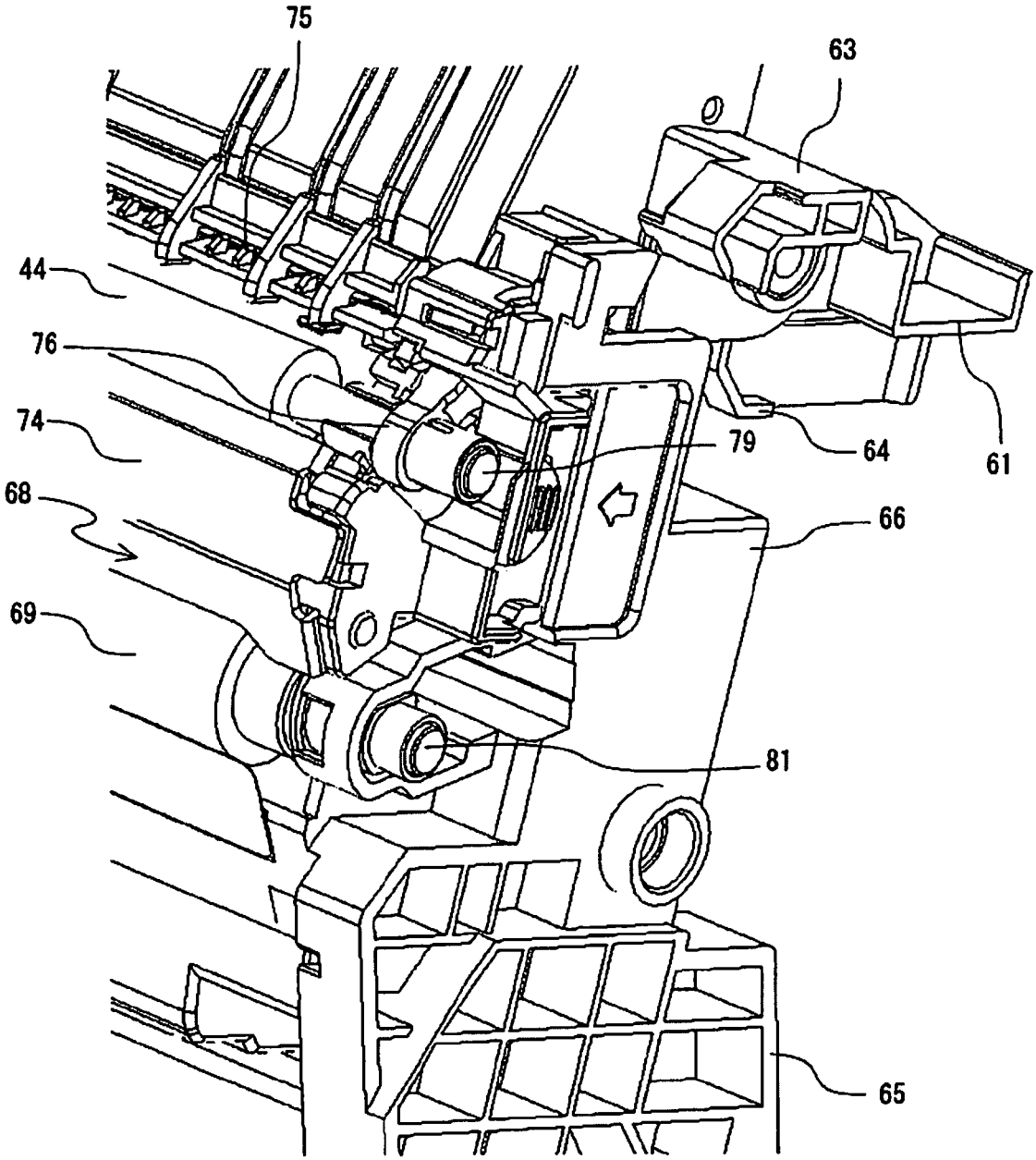
FIG. 15 is a perspective view when viewed from one side of the essential part in the image forming apparatus according to the embodiment of the present invention.
Figure 16:
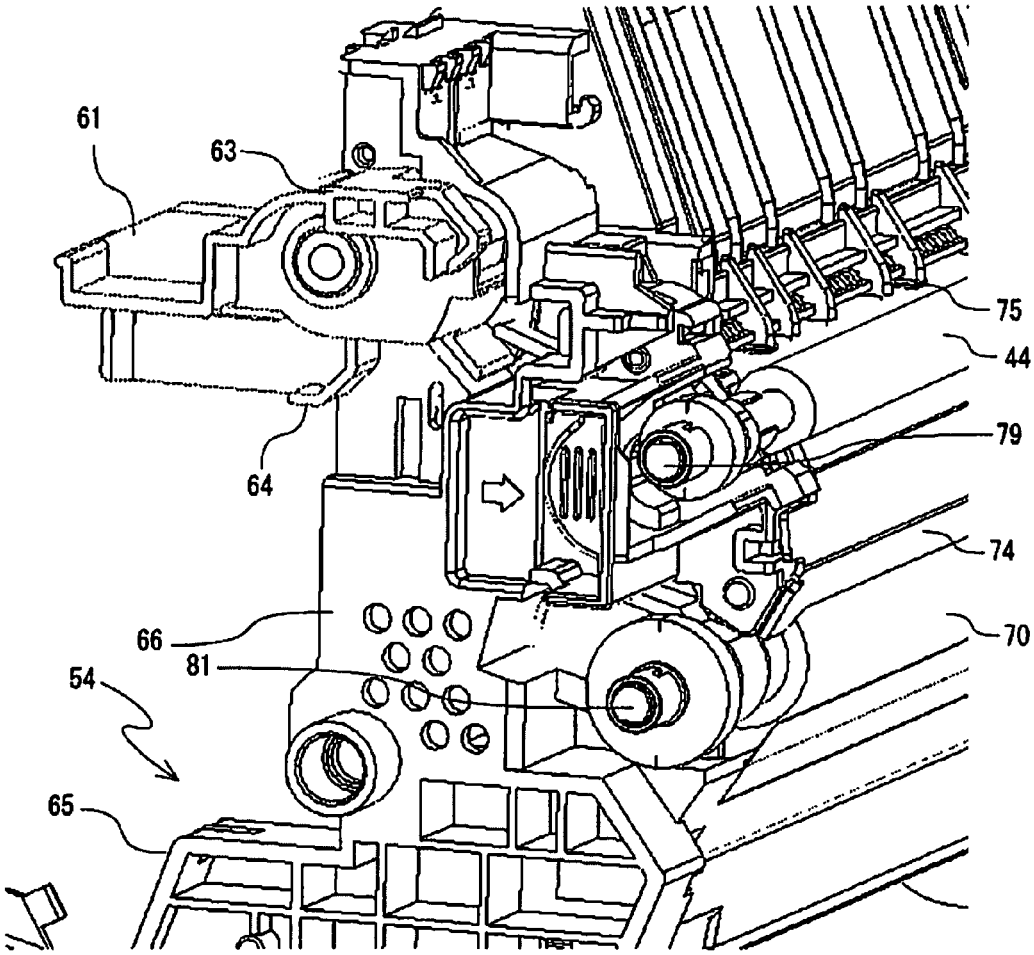
FIG. 16 is a perspective view when viewed from another side of the essential part in the image forming apparatus according to the embodiment of the present invention.
Figure 17:
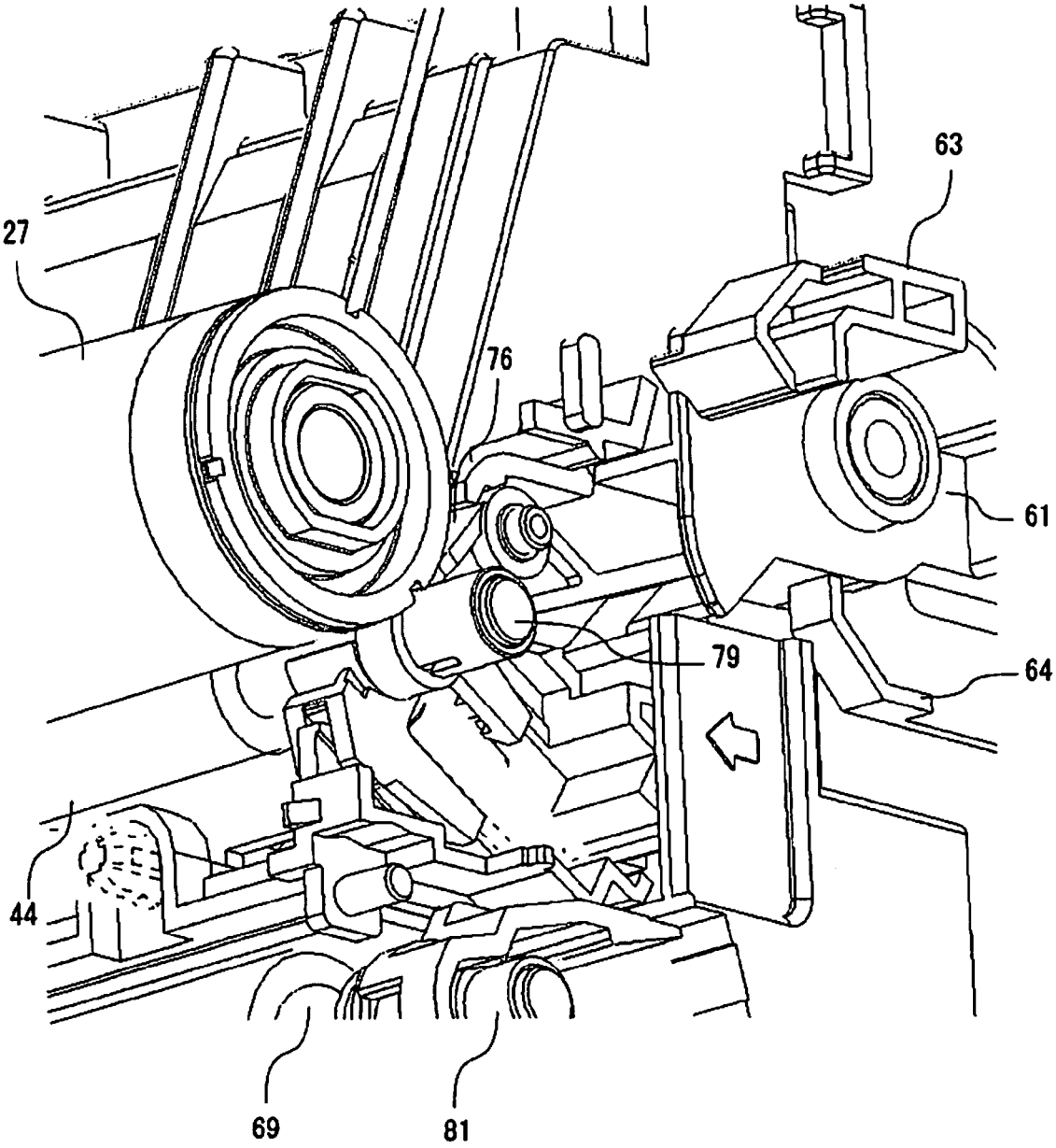
FIG. 17 is a perspective view of the essential part in the image forming apparatus in a locked state according to the embodiment of the present invention.
Figure 18:
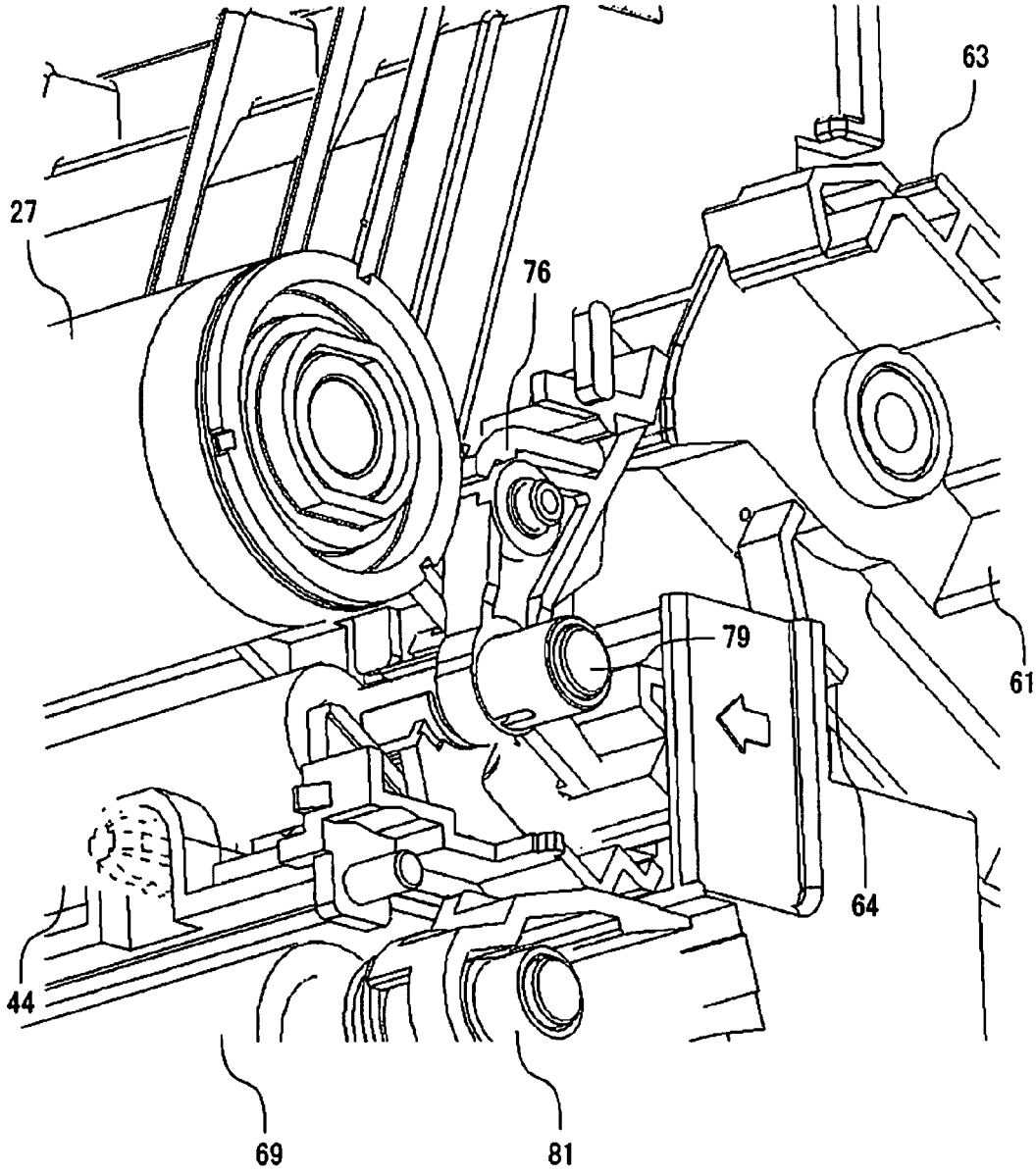
FIG. 18 is a perspective view of the essential part in the image forming apparatus in an unlocked state according to the embodiment of the present invention.

The unit strap guide groove 78 engages with the unit strap 57 (see FIGS. 4 and 5) so as to regulate a movement and an amount of rotational opening of the transfer and feeding unit 54. The transfer roller positioning part 80 engages with transfer roller collars 79 (see FIG. 15) disposed at both ends of the transfer roller 44 so as to position the transfer roller 44. The transfer roller positioning part 80 is formed substantially in the shape of a U-shaped groove. Resist roller positioning parts 82 engage with resist roller collars 81 (see FIG. 15) disposed at both ends of the resist roller 69 so as to position the resist roller 69. Each resist roller positioning part 82 is formed substantially in the shape of a U-shaped groove. The pre-transfer front face guide 83 is opposite to the pre-transfer back face guide 74.

Subsequently, a specific embodiment of the image forming apparatus according to the present invention will be described referring to FIGS. 15 to 18.

The trajectory of the rotation of the transfer and feeding unit 54 around the unit supporting shaft 55 (see FIG. 3) as a rotational fulcrum and the direction of the movement along the groove shape of the transfer roller positioning part 80 (see FIG. 14) forms a large angle. Accordingly, a larger load may act on the transfer roller 44.

In the image forming apparatus of the present invention, transfer roller releasing levers 76 are disposed at both end portions of the transfer roller 44. Each transfer roller releasing lever 76 is configured to be rotatable using the vicinity of the transfer roller 44 as a fulcrum of rotation so as to release the transfer roller 44 along the groove shape of the transfer roller positioning part 80. Also, each transfer roller releasing lever 76 extends to the vicinity of the unit fixing hook 61 disposed on the side panel 51. Each transfer roller releasing lever 76 comes in contact with the unit fixing hook 61, when the unit fixing hook 61 rotates while interlocking with the opening operation of the side panel 51. As described above, each transfer roller releasing lever 76 is configured to release the transfer roller 44 from the resist roller positioning part 80 before.

That is, if a transfer roller releasing lever 76 is not in contact with a unit fixing hook 61, the transfer roller 44 is pressed toward the photosensitive drum 27 by urging exerted by the transfer roller pressing spring 73. In this connection, there is a small clearance between the transfer roller releasing lever 76 and the unit fixing hook 61. Such a clearance prevents the pressing force exerted onto the transfer roller 44 by the transfer roller pressing spring 73 from being unstable. Also, even if the unit fixing hook 61 is to move to a release position, the transfer roller releasing lever 76 regulates movement of the unit fixing hook 61 to the release position by the urging force exerted by the transfer roller pressing spring 73. Accordingly, it is possible to allow the unit fixing hook 61 to be stably locked.

On the other hand, when the unit fixing hook 61 is rotated and the transfer roller 44 is released from the photosensitive drum 27 against the transfer roller pressing spring 73, a spring pressure of the transfer roller pressing spring 73 is configured to act in a direction to lock the unit fixing hook 61 so as to assist a spring pressure of the unit fixing hook 61. In this manner, it is possible to exert the spring pressure of the transfer roller pressing spring 73 on the unit fixing hook 61. And the present invention is not necessary to increase the spring pressure in comparison with a usual image forming apparatus and also realize an operation of opening and closing the transfer and feeding unit 54 with a small operational force. Since there is no fluctuation of the spring pressure in switching between applying and releasing of pressure with respect to the transfer roller 44 according to the present invention, it is possible to obviate occurrence, e.g. a shock or noise while the pressure is applied, so that smooth manipulation feeling is realized. Also, since the unit fixing hook 61 is merely brought into contact with the transfer roller releasing lever 76 in the present invention, it is possible to allow a power loss to be small with a simple and inexpensive configuration.

The preferred embodiment has been described above, but the present invention is not limited to the above-described embodiment but can be put into practice in various forms.

For example, although the image carrier is applied to the photosensitive drum in the above-described embodiment, it is not limited thereto. For example, it may be that the image carrier is applied to an intermediate transfer belt in an image forming apparatus, which includes: a photosensitive drum on the surface of which an electrostatic latent image is formed, a development unit that develops a toner image on the electrostatic latent image formed on the photosensitive drum, the intermediate transfer belt on which the toner image formed on the photosensitive drum by the development unit is primarily transferred, and a secondary transfer roller that secondarily transfers the toner image, which is primarily transferred on a transfer surface of the intermediate transfer belt, on a sheet of transfer paper.

What is claimed is:

1. An image forming apparatus, comprising:

a main body;

an image carrier;

a housing provided with a rotation fulcrum in a lower part thereof;

a transfer roller that is disposed in the housing and configured to be opposite to the image carrier when the housing is rotated around the rotation fulcrum;

a transfer roller pressing member that is disposed in the housing and configured to urge the transfer roller toward the image carrier;

a guide that is disposed in the housing and configured to feed transfer paper;

a fixing hook that is disposed in the housing and configured to be urged in a direction to lock the housing about the main body;

a transfer roller releasing lever that is disposed in the housing and configured to separate the transfer roller from the image carrier against urging performed by the transfer roller pressing member;

a transfer roller positioning part that is disposed in the main body and configured to position the transfer roller; and an operation part configured to cause the fixing hook to rotate in a direction to unlock the housing such that the transfer roller releasing lever rotates in a direction to release the transfer roller from the image carrier.

2. The image forming apparatus according to claim 1, wherein the transfer roller releasing lever is urged onto the transfer roller pressing member such that the fixing hook is restricted from moving to a position to unlock the housing, when the transfer roller is positioned with respect to the image carrier.

3. The image forming apparatus according to claim 1, wherein the operation part is a handle to open and close a panel that constitutes a part of an outer wall of the main body.

* * * * *